US006745817B2

(12) United States Patent
Ban et al.

(10) Patent No.: US 6,745,817 B2
(45) Date of Patent: Jun. 8, 2004

(54) CASTING METHOD AND CASTING APPARATUS

(75) Inventors: Keisuke Ban, Nagano-ken (JP); Akira Sunohara, Nagano-ken (JP); Yasuhiro Sasaki, Nagano-ken (JP); Koichi Ogiwara, Nagano-ken (JP)

(73) Assignee: Nissin Kogyo Co., Ltd., Nagano-Ken (JP)

( * ) Notice: Subject to any disclaimer, the term of this patent is extended or adjusted under 35 U.S.C. 154(b) by 3 days.

(21) Appl. No.: 10/115,141

(22) Filed: Apr. 4, 2002

(65) Prior Publication Data

US 2002/0144799 A1 Oct. 10, 2002

(30) Foreign Application Priority Data

Apr. 5, 2001 (JP) ..... P. 2001-107085

(51) Int. Cl.[7] ..... B22D 27/00; B22D 27/18; B22C 3/00

(52) U.S. Cl. ..... 164/56.1; 164/67.1; 164/72; 164/122.1

(58) Field of Search ..... 164/61, 66.1, 67.1, 164/72, 122.1, 56.1

(56) References Cited

U.S. PATENT DOCUMENTS 2,770,860 A * 11/1956 Webbere ..... 164/68.1
3,302,919 A * 2/1967 Beetle et al. ..... 164/340
4,907,640 A * 3/1990 Jeanneret ..... 164/134
4,913,218 A * 4/1990 Seidinger ..... 164/358
5,647,426 A * 7/1997 Prieto et al. ..... 164/122.1
5,896,912 A * 4/1999 Monroe et al. ..... 164/119
5,954,113 A * 9/1999 Buchborn ..... 164/120
6,171,363 B1 * 1/2001 Shekhter et al. ..... 75/369

FOREIGN PATENT DOCUMENTS

JP 03-230843 10/1991
JP 2000-280063 * 10/2000

* cited by examiner

*Primary Examiner*—Kuang Y. Lin
(74) *Attorney, Agent, or Firm*—McGuireWoods LLP

(57) ABSTRACT

A casting apparatus for performing a casting while an oxide film formed on a surface of a molten metal is reduced by allowing the molten metal and a reducing compound to be contacted with each other, includes: a molding die having a cavity for receiving the molten metal, a sprue from which the molten metal is poured and a feeder head portion arranged between the sprue and the cavity. A difference of heat insulation is partially provided between the feeder head portion and the cavity such that the molten metal filled in the cavity and the feeder head portion is sequentially solidified in a direction of from a terminal portion of the cavity to the feeder head portion.

25 Claims, 7 Drawing Sheets

CASTING METHOD AND CASTING APPARATUS

BACKGROUND OF THE INVENTION

1. Field of the Invention

The present invention relates to a casting method and a casting apparatus, and more particularly to a casting method and a casting apparatus in which a cast product having a desired shape is cast by allowing molten metal poured into an cavity of a molding die and a reducing compound to be contacted with each other whereby an oxide film formed on a surface of the above-described molten metal is reduced.

2. Description of the Related Art

There exist various types of aluminum casting methods such as, for example, a modified aluminum casting method proposed in Japanese Patent Application No. 108078/2000 by two inventors of the present application.

A molding die to be adopted by this modified aluminum casting method is shown in FIG. 8. The molding die 100 thus shown in FIG. 8 is such a molding die made of metal as is used in a gravity casting method; on this occasion, the molding die is of a separate type comprising a lower die 102*a* and an upper die 102*b*. By these dies 102*a* and 102*b*, formed is a cavity 104 in which a cast product having a desired shape is cast.

Further, in the upper die 102*b*, a feeder head portion 108 is formed between a sprue 106 from which molten metal of aluminum or an alloy thereof is poured and the cavity 104, and also air-vent holes 110 from which an air in the cavity 104 is discharged when the molten metal is poured into the cavity 104 is formed.

In the improved aluminum casting method using such molding die 100, after a reducing compound, that is, a magnesium-nitrogen compound ($Mg_3N_2$) is introduced into the cavity 104 of the molding die 100, the molten metal of aluminum or the alloy thereof is poured into the sprue 106 of the molding die 100 and, then, the molten metal is filled in the cavity 104 and the feeder head portion 108 while the air is discharged from the air-vent holes 110.

Next, the molten metal in the cavity 104 is solidified by cooling the molding die 100 in which the molten metal is filled in the cavity 104 and the like as it stands still. A void which is caused by shrinkage with solidification of the molten metal is supplemented by allowing a part of the molten metal in the feeder head portion 108 to be flowed down in the cavity 104.

The improved aluminum casting method is a reduction casting method in which an oxide film formed on a surface of the molten metal of aluminum or the alloy thereof is reduced in the presence of a reducing compound within the cavity 104 of the molding die 100 to decrease a surface tension of the molten metal and, as a result, a flowing property and a running property of the molten metal can be enhanced.

For this feature, in the improved aluminum casting method, coating of a coating agent which is to be coated on surfaces of inner walls of the feeder head portion and the cavity aiming for enhancement of a flowing property and the like of the molten metal and the like on which the oxide film is formed can be omitted thereby enabling to promote a reduction of production steps and enhance a transferring property of the molding die 100.

Now, depending on the shapes of the cast products, there is a case in which the cavity 104 of the molding die 100 is forced to have a shape where a narrow portion having a smaller cross-sectional area than that of a terminal portion is formed halfway between the sprue and the terminal portion. For example, there is a case in which the cavity 104 is forced to have a shape where a first cavity portion 104*a* in which a molten metal inlet of the cavity 104 is arranged and a second cavity portion 104*b*, that is, the terminal portion are connected with a narrow portion 104*c* which is formed narrower than the first cavity portion 104*a* and the second cavity portion 104*b* (hereinafter, also referred to only as cavity portion 104*a* and cavity portion 104*b* respectively, or as cavity portions 104*a* and 104*b* collectively).

In the cavity 104 shown in FIG. 9, after the reducing compound, that is, the magnesium-nitrogen compound ($Mg_3N_2$), is introduced into the cavity 104 of the molding die 100, the molten metal of aluminum or the alloy thereof poured into the sprue 106 is then poured into the first cavity portion 104*a* and, thereafter, poured into the second cavity portion 104*b* via the narrow portion 104*c*. Such pouring, i.e., filling of the molten metal in the cavity 104 is performed in a short period of time by allowing an oxide film formed on the surface of the molten metal to be reduced in the presence of the reducing compound.

However, since the molten metal filled in the narrow portion 104*c* of the cavity 104 is smaller in quantity than that in the cavity portions 104*a* and 104*b* and faster in cooling rate than that filled in the cavity portions 104*a* and 104*b*, the molten metal filled in the narrow portion 104*c* is solidified earlier than that filled in the second cavity portion 104*b*.

For this reason, even when the void is formed while shrinkage is generated with the solidification of the molten metal filled in the second cavity portion 104*b*, the second cavity portion 104*b* is not replenished with the molten metal filled in the first cavity portion 104*a* and the feeder head portion 108, that is, an effect of feeding the molten metal can not be expected whereupon there is a fear that a shrinkage hole or the like may be generated in an obtained cast product.

Meanwhile, though it is possible to solve the shrinkage hole or the like to be generated with the solidification of the molten metal filled in the second cavity portion 104*b* by independently arranging the feeder head portion in each of the cavity portions 104*a* and 104*b*, such an arrangement as forms feeder head portions in a plurality of different places will lead to a complexity of a constitution of the molding die.

Further, since a part of the molten metal which is solidified in the feeder head portion 108 is not a cast product, the portion is cut off to be disposed. Even when it is considered that the thus-cut off portion is reused after being melted again, a loss of energy must be expected.

Therefore, forming feeder head portions in a plurality of different places increases a capacity of a part of non-cast product, decreases a yield of the cast product of the molten metal poured into the molding die 100 and, accordingly, increases a loss in workability and energy.

SUMMARY OF THE INVENTION

Under these circumstances, an object of the present invention is to provide a casting method and a casting apparatus in which, when casting is performed using a molding die in which a number of a feeder head portion to be formed between a sprue and a cavity having a complicated shape is allowed to be as small as possible, a shrinkage hole or the like which is caused by shrinkage with solidification of the molten metal filled in the cavity and which is generated in an obtained cast product can be prevented.

As a result of an extensive study made by the present inventors to solve the above-described problems, it has been found that, in a reduction casting method which allows a reducing compound to be preliminarily present in a cavity 104 of a molding die 100 (shown in FIG. 8), a cooling rate of molten metal filled in a feeder head portion 108 and a narrow portion 104*c* of the cavity 104 can be made slower by coating a coating agent having a heat insulating effect only on surfaces of inner walls of the feeder head portion 108 and the narrow portion 104*c* of the cavity 104, compared with a case in which the surfaces of the inner walls of the feeder head portion 108 and the narrow portion 104*c* of the cavity 104 are not coated by the coating agent.

As described above, the present inventors have found that the shrinkage hole or the like which is caused by shrinkage with solidification of the molten metal filled in the second cavity portion 104*b* of the cavity 104 and which is generated in an obtained cast product can be prevented by allowing the feeder head portion 108 and the narrow portion 104*c* of the molding die 100 to have a higher heat insulating property than other portions of the molding die 100 to attain the present invention.

Namely, according to the present invention, there is provided a casting method for casting a desired shape of a cast product by allowing molten metal poured into a cavity of a molding die and a reducing compound to be contacted with each other while reducing an oxide film formed on a surface of the molten metal, comprising the steps of:

using the molding die in which a feeder head portion is arranged between a sprue from which the molten metal is poured and the cavity and a difference of heat insulation is partially provided between the feeder head portion and the cavity such that the molten metal filled in the cavity and the feeder head portion is sequentially solidified in a direction of from a terminal portion of the cavity to the feeder head portion; and replenishing the cavity with at least a part of the molten metal filled in the feeder head portion, when a void is formed by shrinkage with solidification of the molten metal filled in the cavity.

Further, according to the present invention, there is provided a casting apparatus for performing a casting while an oxide film formed on a surface of a molten metal is reduced by allowing the molten metal and a reducing compound to be contacted with each other, comprising:

a molding die having a cavity for receiving the molten metal, a sprue from which the molten metal is poured and a feeder head portion arranged between the sprue and the cavity, wherein a difference of heat insulation is partially provided between the feeder head portion and the cavity such that the molten metal filled in the cavity and the feeder head portion is sequentially solidified in a direction of from a terminal portion of the cavity to the feeder head portion.

The present invention can preferably be adopted, when the molding die comprising the feeder head portion, arranged between the sprue from which the molten metal is poured and the cavity, and the cavity in which a narrow portion that has a smaller cross-sectional area than the terminal portion is arranged halfway between an inlet, which is in a side of the feeder head portion, of the cavity connected with the feeder head portion and the terminal portion thereof, wherein the feeder head portion and the narrow portion are formed such that they have a higher heat insulating property than the terminal portion, is used.

On this occasion, a difference of heat insulation can easily be provided between the feeder head portion and the terminal portion of the cavity by forming a part of the molding die, in which the feeder head portion is arranged, by a material that has a higher heat insulating property than a material that forms the terminal portion of the cavity of the molding die.

Further, a difference of heat insulation can easily be provided between the narrow portion and the terminal portion even in the cavity by forming a part of the molding die, in which the narrow portion of the cavity is arranged, by a material that has a higher heat insulating property than a material that forms the terminal portion of the cavity.

On the other hand, a difference of heat insulation can easily be provided between the feeder head portion and the narrow portion of the cavity, and the terminal portion of the cavity by using the molding die in which a heat insulating treatment, such as an application of a heat insulating coating agent or the like that is non-reactive to a reducing compound which contacts the molten metal, is performed on a surface of an inner wall of each of the feeder head portion and the narrow portion of the cavity, and the heat insulating treatment is not performed on a surface of an inner wall of the terminal portion of the cavity.

Further, a part of the molding die, in which the feeder head portion is arranged, can be used as a common member by using the molding die in which a part of the molding die, in which the feeder head portion is arranged, is constructed such that the part is detachable from a cavity portion of the molding die.

According to the present invention, when molten metal of aluminum or an alloy thereof is used as the molten metal, a magnesium-nitrogen compound which is obtained by allowing a magnesium gas and a nitrogen gas to be reacted with each other as raw materials can preferably be used as the reducing compound.

Further, blocking or the like by the reducing compound in a halfway of an introducing passage leading to the cavity can be prevented by arranging a molten metal-introducing passage that introduces the molten metal into the feeder head portion and an introducing passage that introduces a raw material of a reducing compound into the cavity such that the reducing compound is generated in the cavity in a part of the molding die in which the feeder head portion is arranged.

In the present invention, a difference of heat insulation is partially provided in the feeder head portion and the cavity such that the molten metal filled in the feeder head portion, that is formed between the sprue from which the molten metal is poured and the cavity, and the cavity is sequentially solidified in a direction of from a terminal portion of the cavity to the feeder head portion For this provision, when the molten metal is sequentially solidified in a direction of from the terminal portion of the cavity to the feeder head portion and a void is formed in the cavity caused by shrinkage with solidification of the molten metal, a part of the molten metal filled in the feeder head portion is flowed into the cavity for replenishment, that is, the effect of feeding the molten metal is secured until the molten metal filled in the cavity is fully solidified and, as a result, the shrinkage hole or the like to be generated in the cast product to be obtained can be prevented.

DETAILED DESCRIPTION OF THE PREFERRED EMBODIMENTS

Figure 1:
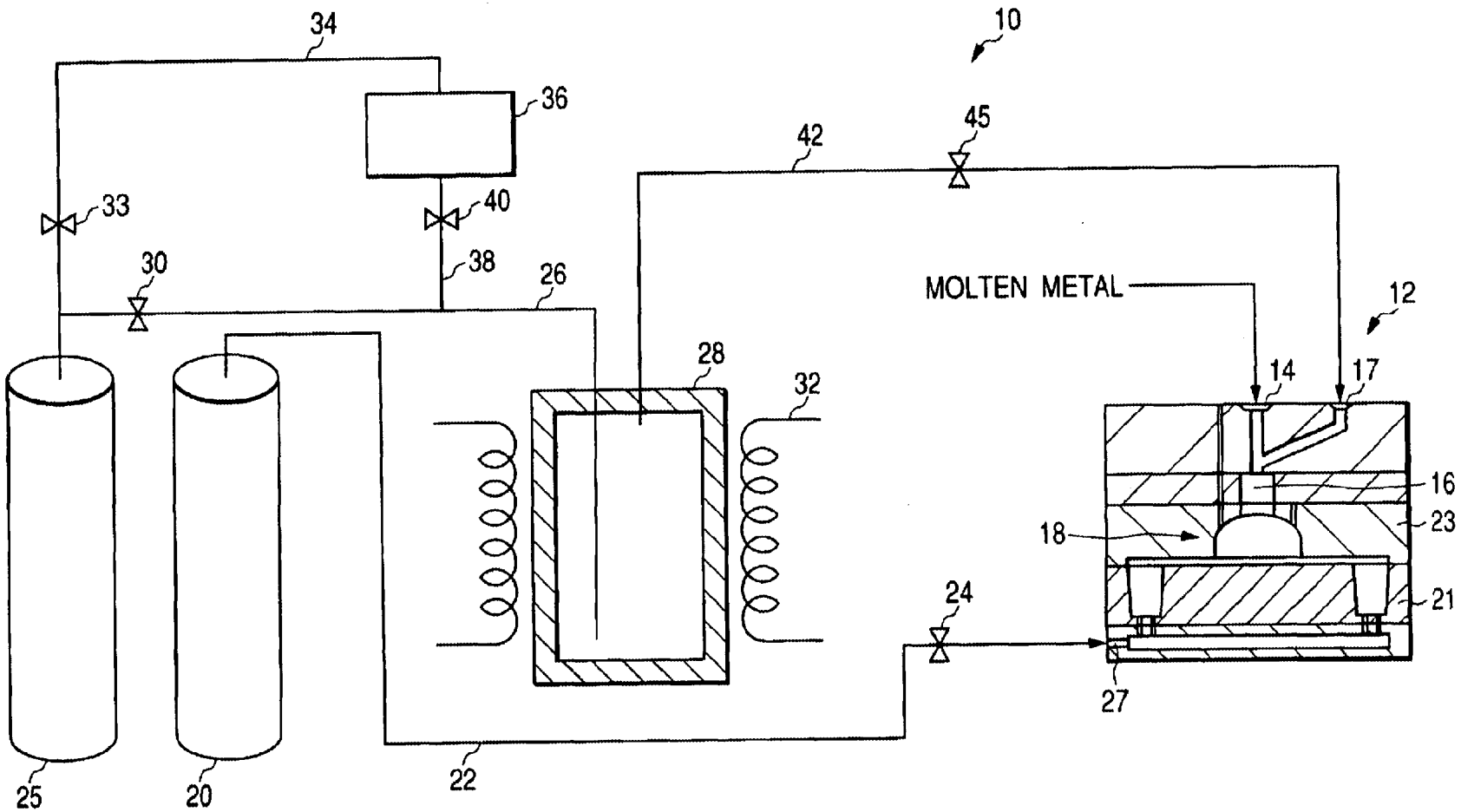
FIG. 1 is a schematic diagram explaining a first embodiment of a casting apparatus according to the present invention.

A schematic diagram of a casting apparatus according to the present invention is shown in FIG. 1. In the casting apparatus 10 shown in FIG. 1, arranged is a molding die 12 that comprises a cavity 18 connected with a sprue 14 from which molten metal of aluminum or an alloy thereof is poured.

The molding die 12 is connected with a steel cylinder 20 containing a nitrogen gas by a piping system 22 and, by opening a valve 24 of the piping system 22, the nitrogen gas is poured from a nitrogen gas-introducing port 27 into the cavity 18 to allow an inside of the cavity 18 to be in a nitrogen-gas atmosphere, that is, substantially in a non-oxygen atmosphere.

Further, a steel cylinder 25 containing an argon gas is connected with a furnace 28 as a generator which generates a metallic gas by a piping system 26 and, by opening a valve 30 which is arranged in the piping system 26, the argon gas is poured into the furnace 28 an inside of which is formed such that it can be heated by a heater 32; on this occasion, in order to generate a magnesium gas as a metallic gas to be described below, a temperature inside the furnace 28 is set to be 800° C. or more at which magnesium powders are sublimed.

A quantity of the argon gas to be poured into the furnace 28 can be adjusted by the valve 30 such that a flowing quantity of the argon gas is allowed to be in a predetermined flowing quantity also between the valve 30 of this piping system 26 and the furnace 28.

Such a steel cylinder 25 containing the argon gas as described above is connected with a tank 36 containing magnesium powders by a piping system 34 in which a valve 33 is interposed. The tank 36 is connected with a piping system 26 positioned in a downstream side of the valve 30 by a piping system 38. A valve 40 is also interposed in the piping system 38. The furnace 28 is connected with a metallic gas-introducing port 17 of the molding die 12 via a piping system 42; on this occasion, the metallic gas which has been gasified in the furnace 28 is introduced into the cavity 18 via the metallic gas-introducing port 17. A valve 45 is also interposed in the piping system 42.

When the argon gas is poured from the steel cylinder 25 containing the argon gas into the cavity 18 of the molding die 12 via the furnace 28, the quantity of the argon gas to be poured into the cavity 18 can be adjusted by the valve 45.

Figure 2A:
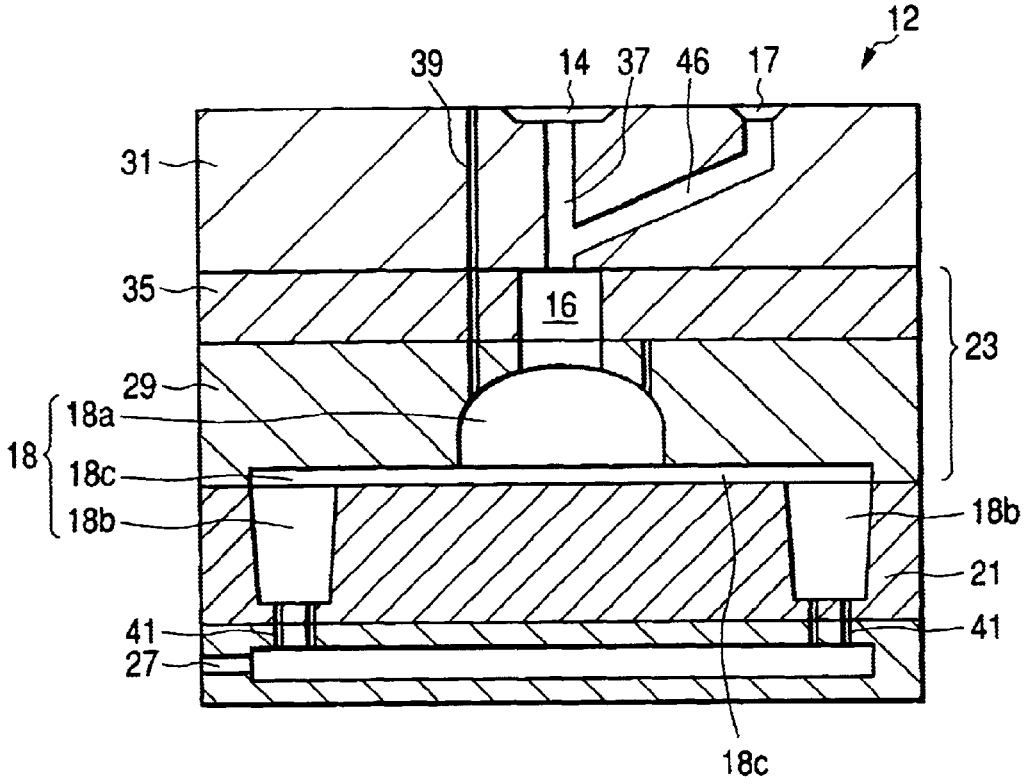
FIG. 2A is a cross-sectional view of a molding die used in the casting apparatus shown in FIG. 1.

The molding die 12 used in the casting apparatus shown in FIG. 1 comprises a lower die 21, an upper die 23 and an adaptor 31 as shown in FIG. 2A. The upper die 23 comprises a metallic plate 29 and an inserting plate 35 comprising a material, which has a higher heat insulating property than a metal, such as ceramic. The adaptor 31 is formed by firing calcium carbonate. This molding die 12 is of a separate type in which these members are laminated with one another in a separable manner.

The cavity 18 in which the cast product having a desired shape is cast is formed by the lower die 21 and the metallic plate 29 of the upper die 23. As shown in FIG. 2A, in this cavity 18, a first cavity portion 18*a* in which a molten metal inlet of the cavity 18 is arranged and a terminal portion, that is, a second cavity portion 18*b* are connected with each other by a narrow portion 18*c* which is formed narrower than the first cavity portion 18*a* and the second cavity portion 18*b* (hereinafter also referred to only as cavity portion 18*a* and cavity portion 18*b* respectively, or as cavity portions 18*a* and 18*b* collectively).

Further, a molten metal passage 37 which introduces the molten metal poured into a sprue 14 into the cavity 18 and a feeder head portion 16 are arranged between the sprue 14 which is arranged in an adaptor 31 and into which the molten metal of aluminum or the alloy thereof is poured and the cavity 18. The feeder head portion 16 is arranged nearest to the molten metal inlet of the first cavity portion 18*a* and is mainly formed in an inserting plate 35 which constitutes the upper die 23. A cross-sectional area of the feeder head portion 16 is larger than that of the molten metal passage 37; further, a capacity of the feeder head portion 16 is preferably set as being from 5% to 20% of a capacity of the cavity 18.

To this molten metal passage 37, connected is a metallic gas-introducing passage 46 led from a metallic gas-introducing port 17 into which a metallic gas gasified in the furnace 28 is introduced.

Further, exhaust holes 39 which discharge a gas in the cavity 18 are formed in the adaptor 31 and the upper die 21. introducing passages 41 which introduces a nitrogen gas led from the nitrogen gas-introducing port 27 into the cavity 18 are formed in the lower die 21.

Figure 2B:
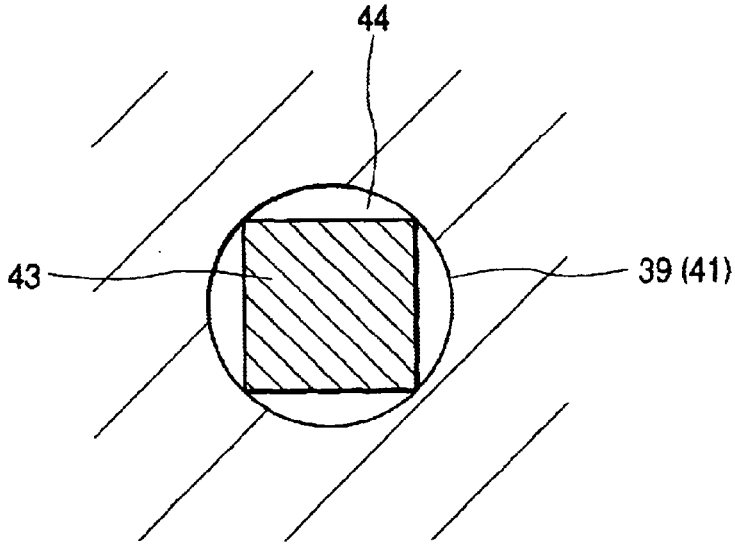
FIG. 2B is a partially enlarged view of the molding die shown in FIG. 2A.

As shown in FIG. 2B, each of such exhaust holes 39 and introducing passages 41, which is a hole having an annular cross-sectional shape and into which an inserting body 43 having a square pillar cross-sectional shape is inserted, communicates with an inside of the cavity 18 via a vault shape passages 44.

In the molding die 12 shown in FIGS. 1 to 2B, the sprue 14, the molten metal passage 37, the metallic gas-introducing port 17, the metallic gas-introducing passage 46 and a part of the exhaust hole 39 are arranged in the adaptor 31 which is formed by firing calcium sulfate. It is required to form the molten metal passage 37 and other members in accordance with a shape of the cavity 18 and an arrangement of a pushing pin (not shown) which pushes the cast product out and the like, but such a requirement can be satisfied by arranging the molten metal passage 37 and the like adapted for the cast product to be cast in the adaptor 31.

Further, in the molding die 12 shown in FIGS. 1 to 2B, the feeder head portion 16 is substantially formed in an inserting plate 35 made of a material such as ceramic which has a substantially higher heat insulating property than a metal. The feeder head portion 16 is formed such that it has a higher heat insulating property than the cavity portions 18*a* and 18*b* of the cavity 18 in which metallic surfaces are exposed, defined by the metallic lower die 21 and a metallic plate 29 which constitutes the upper die 23.

Further, a heat insulating treatment such as coating of a heat insulating coating agent and the like is performed on an surface of the inner wall of each of the narrow portions 18*c* of the cavity 18 whereupon the narrow portions 18*c* is formed such that they have a higher heat insulating property than the cavity portions 18*a* and 18*b* in which metallic surfaces thereof are exposed.

As the heat insulating coating agent, a high heat insulating coating agent, which is non-reactive to a reducing compound to be described below, is used. Examples of such coating agents include, for example, a non-oxide type coating agent such as ceramic-compounded graphite and the like.

Further, as the heat insulating treatment on the narrow portions 18*c*, a treatment which subjects each of the metallic surfaces exposed on the surface of the inner walls thereof to a heating treatment to convert it into iron tetroxide surfaces or another treatment such as nitridation processing can advantageously be adopted.

As described above, by forming the feeder head portion 16 of the molding die 12 and the narrow portions 18*c* such that each of them has a higher heat insulating property than the cavity portions 18*a* and 18*b*, and the cooling rate of the molten metal filled in the feeder head portion 16 and the narrow portions 18*c* can be made slower than that of the molten metal filled in the cavity portions 18*a* and 18*b* whereupon a large difference of cooling rate can be established between the feeder head portion 16 and the cavity portions 18*a* and 18*b*.

As described above, by establishing the large difference of cooling rate between the feeder head portion 16 and the cavity portions 18*a* and 18*b*, the molten metal filled in the feeder head portion 16 can sufficiently exert an effect of feeding the molten metal which flows into the cavity portions 18*a* and 18*b* compared with the molding die 100 (FIG. 9) in the related art; such a case as described above will be explained below with reference to FIGS. 3A and 3B.

Figure 3A:
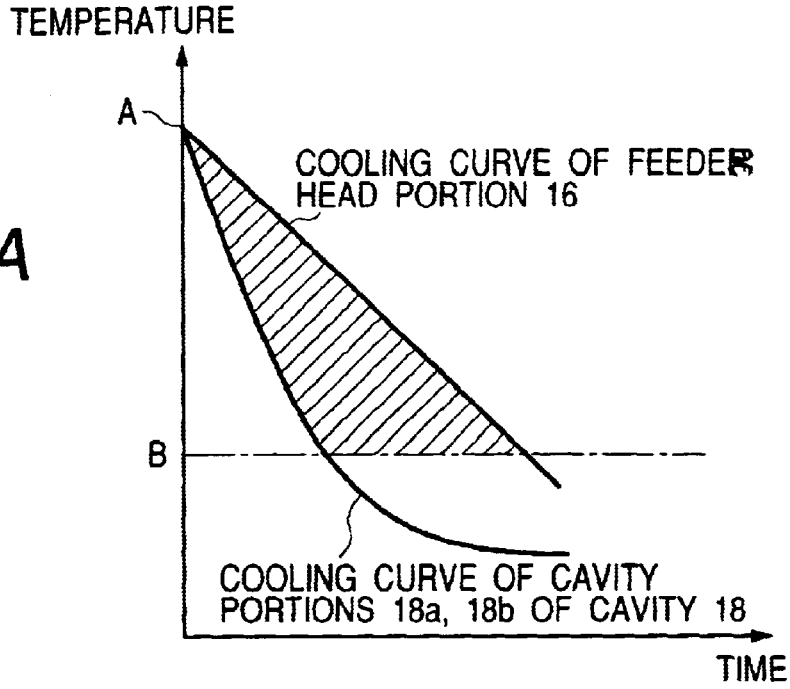
FIG. 3A is a graph showing a cooling rate of molten metal filled in each of a feeder head portion and a cavity of a molding die used in the casting apparatus shown in FIG. 1.

In FIG. 3A, a point marked as A represents a temperature of the molten metal which is poured into the molding die 12 and a point marked as B represents a temperature of the molten metal which is fully solidified therein. Therefore, an area in which the molten metal filled in the feeder head portion 16 can flows into the cavity portions 18*a* and 18*b* to exert a substantial effect of feeding the molten metal is a shaded portion shown in FIG. 3A.

Figure 3B:
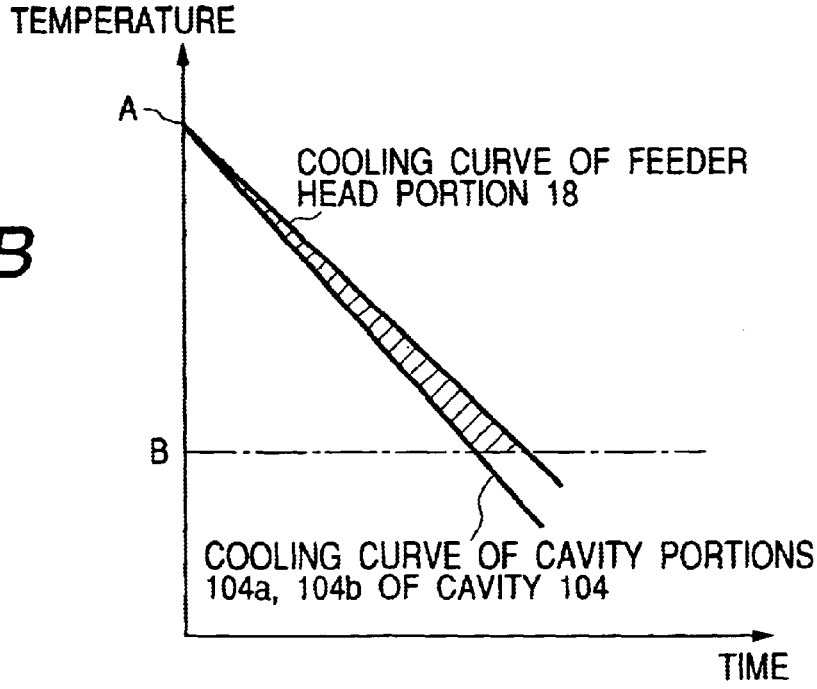
FIG. 3B is a graph showing a cooling rate of molten metal filled in each of a feeder head portion and a cavity of a conventional molding die used in the casting apparatus shown in FIG. 1.
Figure 9:
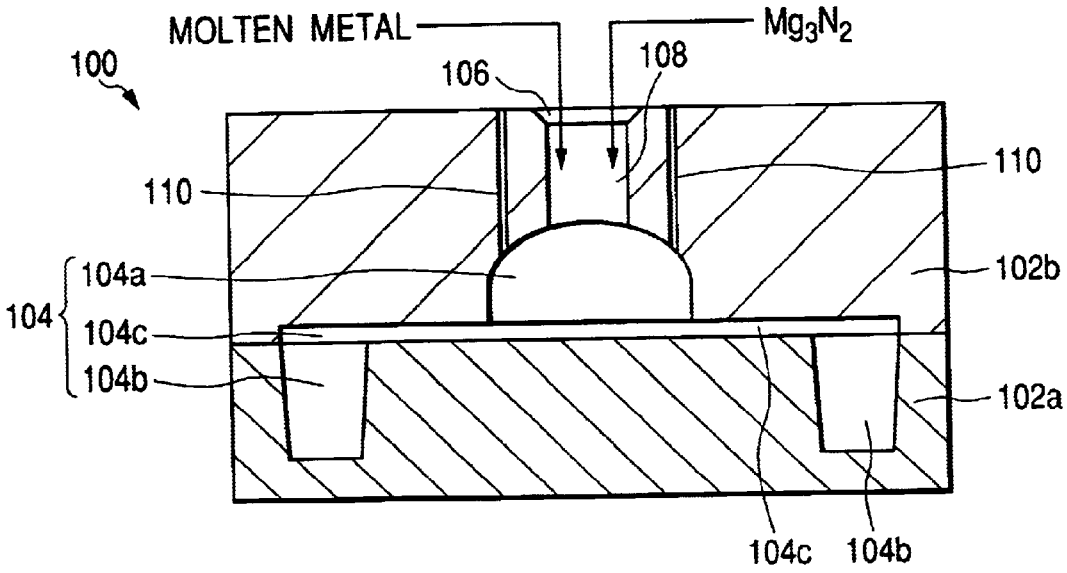
FIG. 9 is a cross-sectional view of a molding die in which a shape of a cavity is complicated whereupon a shrinkage hole or the like is likely to be generated.

On the other hand, since a molding die 100 of the related art shown in FIG. 9 is coated with a heat insulating coating agent on the surface of the inner wall of the feeder head portion 108 and the surface of the inner wall of each of the cavity portions 104*a* and 104*b*, and the molding die 12 is allowed to be a coated die in which thickness of a coating film on the surface of the inner wall of the feeder head portion 108 is larger than that of the coating film on the surface of the inner wall of each of the cavity portions 104*a* and 104*b*, the cooling rate of the molten metal filled in the feeder head portion 108 can be made slower than that of the molten metal filled in the cavity portions 104*a* and 104*b*, as shown in FIG. 3B.

However, in the molding die 100 of the related art shown in FIG. 3B, the difference of the cooling rate is small compared with the molding die 12 shown in FIG. 3A whereupon the area in which the molten metal filled in the feeder head portion 108 can flow into the cavity portions 104*a* and 104*b* to exert a substantial effect of feeding the molten metal is also narrow.

To contrast, in the molding die 12 shown in FIG. 3A, the difference of the cooling rate is large compared with the molding die 100 of the related art shown in FIG. 3B whereupon, since the area in which the substantial effect of feeding the molten metal can be exerted is wide, even when the feeder head portion is allowed to be smaller in size, the difference of solidification time of molten metal between the molten metal filled in the feeder head portion 16 and that filled in the cavity portions 18*a* and 18*b* constituting the cavity 18 can be secured.

Further, in the molding die 12 shown in FIGS. 1 to 2B, the narrow portion 18*c* which connects the cavity portion 18*a* with the cavity portion 18*b* is formed such that it has a higher heat insulating property than the cavity portions 18*a* and 18*b*. By this feature, it can be prevented that the molten metal filled in the narrow portion 18*c* is solidified earlier than the molten metal filled in the second cavity portion 18*b*. Accordingly, the effect of feeding the molten metal filled in the feeder head portion 16 is extended not only to the first cavity portion 18*a* which is arranged nearest to the feeder head portion 16, but also to the second cavity portion 18*b* via the narrow portion 18*c*. As a result, it can be prevented that the molten metal filled in the narrow portion 18*c* as a part of the molten metal filled in the cavity 18 is solidified earlier than the molten metal filled in the second cavity 18*b* and that a shrinkage hole and the like caused by shrinkage with solidification of the molten metal filled in the second cavity portion 18*b* is generated.

An order of solidification of the molten metal filled in the cavity 18 and the feeder head portion 16 of the molding die 12 shown in FIGS. 1 to 2B is changeable in accordance with not only an intense of the heat insulating property in each portion, but also a quantity, a heat releasing area and the like of the molten metal filled in each of the cavity portions 18*a* and 18*b*, the narrow portions 18*c* and the feeder head portion 16.

In the molding die 12 shown in FIGS. 1 to 2B, since a capacity of the first cavity portion 18*a* is larger than that of the second cavity portion 18*b*, the order of solidification of the filled molten metal can be adjusted by adjusting an intense of the heat insulating treatment to be performed on the surface of the inner wall of the narrow portion 18*c* such that it is set as being from the second cavity portion 18*b* to the narrow portion 18*c* to the first cavity portion 18*a* to the feeder head portion 16 in this order.

As shown in FIG. 3A, it can be attained not only by setting the cooling rate of the molten metal filled in the cavity 18 as being 500° C./min or more (preferably 700° C./min or more) but also by setting the cooling rate of the molten metal poured into the feeder head portion 16 as being less than 500° C./min (preferably 300° C./min or less) in order to fully secure the difference of solidification time of the molten metal between the molten metal filled in the feeder head portion 16 and the molten metal filled in the cavity portions 18*a* and 18*b* of the cavity 18. Particularly, it is preferable to adjust the difference of the cooling rate therebetween to be 200° C./min or more.

On this occasion, a space between dendrites of aluminum filled and then solidified in the cavity 18 in which the cooling rate is adjusted to be 500° C./min or more is less than 25 μm at an average whereas that between dendrites of aluminum filled and then solidified in the feeder head portion 16 in which the cooling rate is adjusted to be less than 500° C./min is less than 25 μm at an average.

The fact that the space between such dendrites of aluminum is small indicates that a crystal structure of aluminum is dense; this feature is advantageous, since a mechanical strength and the like of an obtained aluminum cast product can be enhanced. For this reason, it is preferable that the space between the dendrites of aluminum is allowed to be 23 μm or less and particularly 20 μm or less.

Further, in a part of aluminum filled and solidified in the feeder head portion 16, a space between the dendrites is larger than that in a part of aluminum filled and solidified in the cavity 18 and, accordingly, a mechanical strength in the former part is inferior to that in the latter part; however, since the former part can be cut off from a product which is the latter part, there causes no problem.

When aluminum casting is performed by using a casting apparatus 10 shown in FIGS. 1 to 2B, firstly, the valve 24 is opened and a nitrogen gas is introduced from the steel cylinder 20 containing the nitrogen gas into the cavity 18 of the molding die 12 via the piping system 22 thereby discharging an air present in the cavity 18 by the nitrogen gas. The air present in the cavity 18 is discharged through exhaust holes 39 whereupon an inside of the cavity 18 is allowed to be in a nitrogen gas atmosphere, that is, substantially in a non-oxygen atmosphere. Thereafter, the valve 24 is closed.

While the air present in the cavity 18 of the molding die 12 is being purged, the valve 30 is opened and the argon gas is poured from the steel cylinder 20 containing the argon gas to into the furnace 28 to allow an inside of the furnace 28 to be in a non-oxygen condition.

Next, the valve 30 is closed and, then, the valve 40 is opened to send magnesium powders contained in the tank 38 into the furnace 28 along with the argon gas by an argon gas pressure. The furnace 28 is beforehand heated by the heater 32 to a temperature of 800° C. or more at which the magnesium powders are sublimed. By taking this arrangement, the magnesium powders sent into the furnace 28 are sublimed to be a magnesium gas.

Next, the valve 40 is closed and, then, the valve 30 and the valve 45 are opened to pour the magnesium gas into the cavity 18 via the piping system 42, the metallic gas-introducing port 17 of the molding die 12, the metallic gas-introducing passage 46, the molten metal passage 37 and the feeder head portion 16 while pressure and a flow rate of the argon gas are adjusted.

After the magnesium gas is poured into the cavity 18, the valve 45 is closed and the valve 24 is opened to pour the nitrogen gas from the nitrogen gas introducing port 17 into the cavity 18 via the introducing passages 41. As described above, by pouring the nitrogen gas into the molding die 12, the magnesium gas and the nitrogen gas are allowed to be reacted with each other in the cavity 18 to generate the magnesium-nitrogen compound ($Mg_3N_2$) This magnesium-nitrogen compound is deposited on the surface of the inner wall of the cavity 18 in powder form.

The nitrogen gas is poured into the cavity 18 while the pressure and the flow rate thereof are appropriately adjusted. It is preferable that the nitrogen gas may be preheated before being poured into the cavity 12 in order that a temperature of the molding die 12 is not decreased such that the nitrogen gas and the magnesium gas can easily be reacted with each other. The reaction time may be from about 5 seconds to about 90 seconds (preferably from about 15 seconds to about 60 seconds). Even when the reaction time is longer than 90 seconds, there is a tendency that the temperature of the molding die 12 is decreased to deteriorate a reaction property.

In a state in which the magnesium-nitrogen compound is deposited on the surface of the inner wall of the cavity 18, the molten metal of aluminum is poured from the sprue 12*a* into the cavity 18 via the molten metal passage 37 and the feeder head portion 16. In the cavity 18, the molten metal poured into the feeder head portion 16 is poured into the second cavity portion 18*b* via the first cavity portion 18*a* and the narrow portion 18*c*. Such a pouring operation of the molten metal is continued until the cavity 18, the feeder head portion 16 and the sprue 14 are all filled with the molten metal.

When the molten metal is poured, the molten which has been poured into the cavity 18 is contacted with the magnesium-nitrogen compound deposited on the surface of the inner wall of the cavity 18, and an oxide film on the surface of the molten metal is deprived of oxygen by the magnesium-nitrogen compound whereupon the surface of the molten metal is reduced to pure aluminum.

Further, the oxygen remaining in the cavity 18 is reacted with the magnesium-nitrogen compound to generate magnesium hydroxide or magnesium oxide which is then taken in the molten metal. Since the thus-generated magnesium oxide or the like is small in quantity and a safe compound, it will not give an adverse effect on a quality of the aluminum cast product to be obtained.

As described above, since the magnesium-nitrogen compound forms pure aluminum by depriving the oxide film on the surface of the molten metal of oxygen whereby casting is performed without forming the oxide film on the surface of the molten metal. For this reason, a case in which a surface tension of the molten metal is increased by the oxide film during casting processing is prevented whereupon a wetting property, a flowing property and a running property of the molten metal are allowed to be favorable. As a result, an advantageous cast product excellent in a transferring property (flatness) of a surface texture relative to the surface of the inner wall of the cavity 18 and having no surface fold and the like can be obtained.

An order of solidification of the molten metal filled in the cavity 18, the feeder head portion 16 and the like is changeable in accordance with not only an intense of the heat insulating property in each portion, but also a quantity, a heat releasing area of the molten metal filled in each of the cavity portions 18*a* and 18*b* of the cavity 18, the narrow portion 18*c* and the feeder head portion 16 and the like.

On this point, in the molding die 12 shown in FIGS. 1 to 2B, since a capacity of the first cavity portion 18*a* is larger than that of the second cavity portion 18*b*, the order of solidification of the filled molten metal can be adjusted by adjusting an intense of the heat insulating treatment performed on the surface of the inner wall of the narrow portion 18*c*. such that it is set as being from the second cavity portion 18*b* to the narrow portion 18*c* to the first cavity portion 18*a* to the feeder head portion 16 in this order.

For this reason, a part of the molten metal filled in the feeder head portion 16 and the cavity 18, that is, the molten metal filled in the second cavity portion 18*b* starts to be solidified and, even when a void is formed in the second cavity portion 18*b* by shrinkage with solidification of the molten metal, since the molten metal filled in the narrow portion 18*c*, the first cavity portion 18*a* and the feeder head portion 16 can exhibit a flowing property, the molten metal filled in the first cavity portion 18*a* and the feeder head portion 16 flows into the second cavity portion 18*b* via the narrow portion 18*c* to fill the void generated therein.

Subsequently, after the molten metal filled in the second cavity portion 18*b* and the narrow portion 18*c* is solidified, the molten metal filled in the first cavity portion 18*a* starts to be solidified and, even when a void is formed in the first cavity portion 18*a* by shrinkage with solidification of the molten metal, since the molten metal filled in the feeder head portion 16 can exhibit a flowing property, the molten metal filled in the feeder head portion 16 flows into the first cavity portion 18*a* to fill the void generated therein.

As described above, in the molding die 12 shown in FIGS. 1 to 2B, the void generated by shrinkage with solidification of the molten metal filled in the cavity portions 18*a* and 18*b* can be supplemented with the molten metal and, as a result, a favorable cast product having no shrinkage hole and the like can be cast.

Figure 4A:
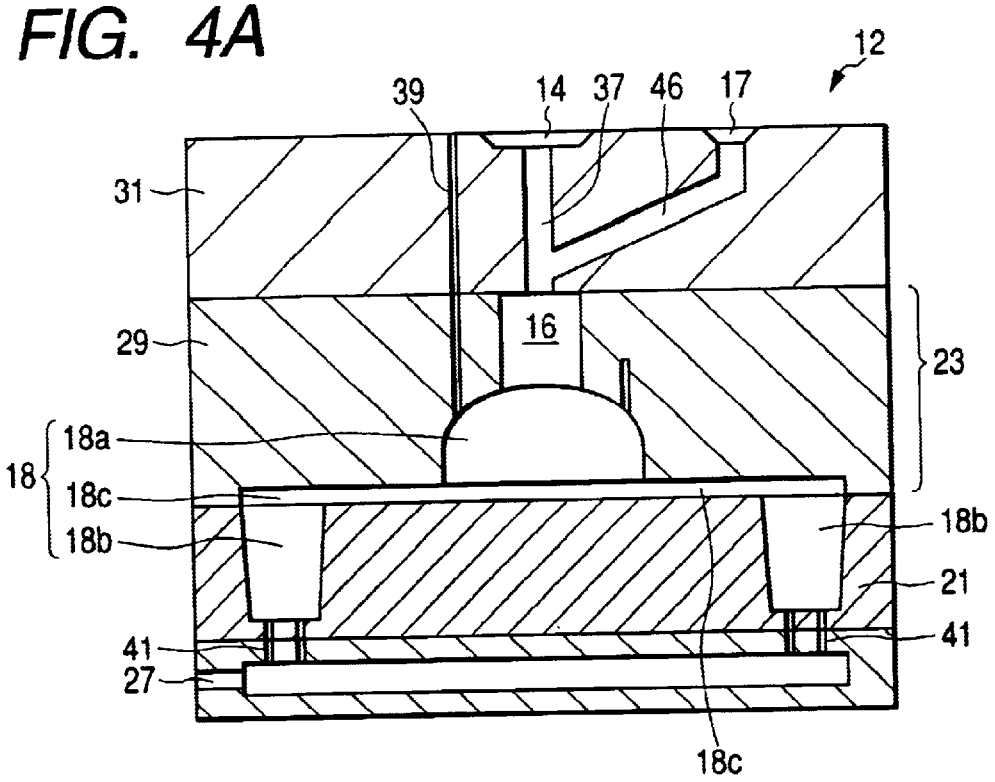
FIGS. 4*a* and 4*b* are each a cross-sectional view explaining a second embodiment of a molding die according to the invention.

In the molding die shown in FIGS. 1 to 2B, the feeder head portion 16 is arranged in the inserting plate 35 which has a higher heat insulating property than a metallic plate; however, as shown in FIG. 4A, the feeder head portion 16 may be arranged in the metallic plate 29 which constitutes the upper die 23. In this case, the surface of the inner wall of the feeder head portion 16 and the surface of the inner wall of the narrow portion 18*c* is subjected to a heat insulating treatment such as application of a heat insulating coating agent or the like to allow these surfaces to have a higher heat insulating property than the cavity portions 18*a* and 18*b* which each has an exposed metallic surface.

As the heat insulating coating agent to be applied on the surface of the inner wall of the feeder head portion 16, the coating agent which has a high insulating property and is non-reactive to the reducing compound is used. Examples of such coating agents include, for example, a non-oxide type coating agent such as ceramic-compounded graphite and the like.

As described above, since the heat insulating coating agent is applied on the surface of the inner wall of each of the feeder head portion 16 and the narrow portion 18*c*, a starting time of solidification of the molten metal filled in the cavity 18 and the feeder head portion 16 can easily be adjusted by adjusting a coating thickness and the like to set an order thereof as being from the second cavity portion 18*b* to the narrow portion 18*c* to the first cavity portion 18*a* to the feeder head portion 16 in this order.

In the molding die 12 shown in FIGS. 1 to 2B, the molten metal filled in the feeder head portion 16 is allowed to be flowed into the cavity 18 by a force of gravity; however, it is possible that the adaptor 31 shown in FIG. 4A is arranged to be detachable from the upper die 23 and, when the molten metal filled in the cavity 18 is solidified, the adaptor 31 is detached therefrom and then, by forcibly pushing the molten metal filled in the feeder head portion 16 into a side of the cavity 18, generation of the shrinkage hole or the like in the cast product to be obtained can be reduced.

Timing of this pushing of the molten metal filled in the feeder head portion 16 is when the molten metal filled in the cavity 18 is substantially in a solidified state and, simultaneously, the molten metal in the feeder head portion 16 maintains a flowing property. It is preferable that the optimum timing of such pushing is preliminarily determined in accordance with each molding die 12 based on experiments, since the optimum timing differs depending on the molding dies 12.

Figure 4B:
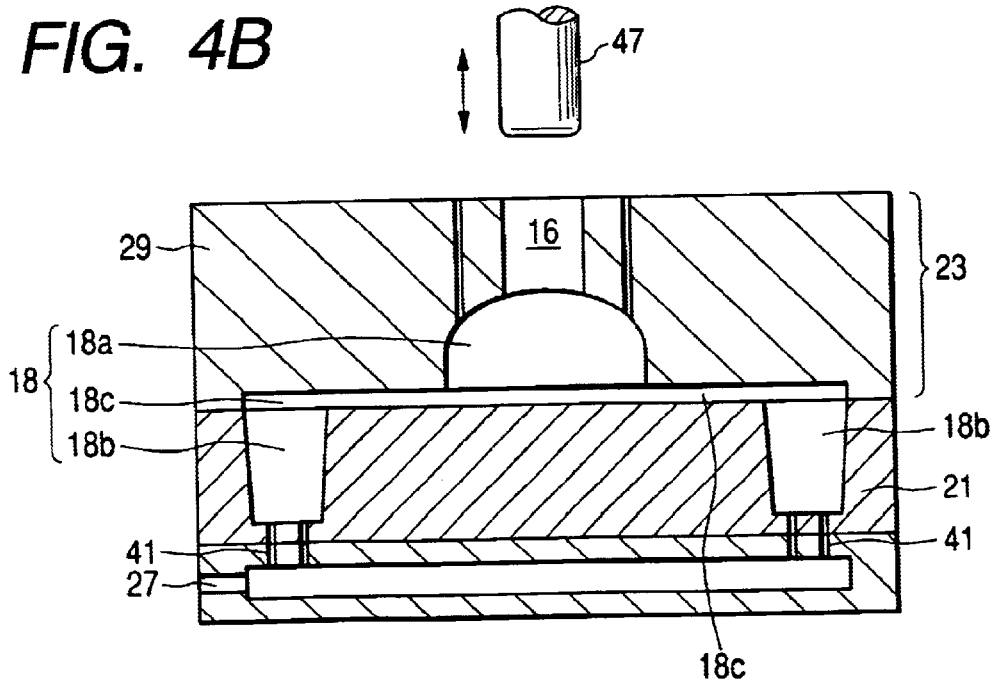

Further, as a device which pushes the molten metal filled in the feeder head portion 16, a piston 47 which can move up and down as shown in FIG. 4B can be used.

Furthermore, even in the molding die 12 shown in FIGS. 1 to 2B, as shown in FIGS. 4A and 4B, when the molten metal in the feeder head portion 16 is pushed by using the piston 47 which can move up and down as a pushing device, the adaptor 31 may be arranged such that it is detachable or both the inserting plate 35 and the adaptor 31 may be arranged such that thy are detachable.

Figure 5:
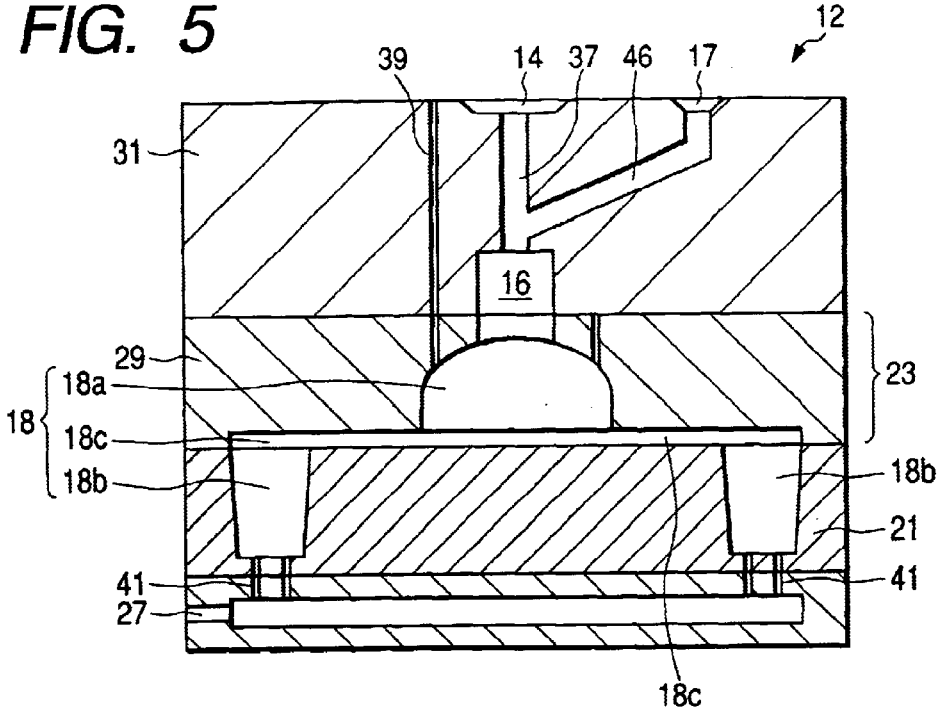
FIG. 5 is a cross-sectional view of a third embodiment of a molding die according to the invention.

In the molding die 12 shown in FIGS. 1, 2A, 2B, 4A and 4B, the feeder head portion 16 is arranged in the upper die 23; however, since a portion formed by solidifying the molten metal filled in the feeder head portion 16 is a cut-off portion which is to be cut off from the cast product, it is not necessary to arrange it in the upper die 23 made of metal. For this reason, the feeder head portion 16 may be formed through both of the adaptor 31 formed by firing calcium sulfate and the upper die 23. In this case, since the adaptor 31 which has been formed by firing calcium sulfate has a lower heat conductivity, that is, a favorable heat insulating property than the lower and upper dies 21 and 23 made of metal. Therefore, as shown in FIG. 5, the feeder head portion 16 is formed such that a capacity of a part of the feeder head portion 16 arranged in the adaptor 31 becomes larger than that of the feeder head portion 16 arranged in the upper die 23, whereby it is possible to improve the heat insulating property of the feeder head portion 16 without applying the heat insulating coating agent on the surface of the inner wall thereof compared with the cavity 18 arranged in the lower and upper dies 21 and 23 made of metal.

Figure 6:
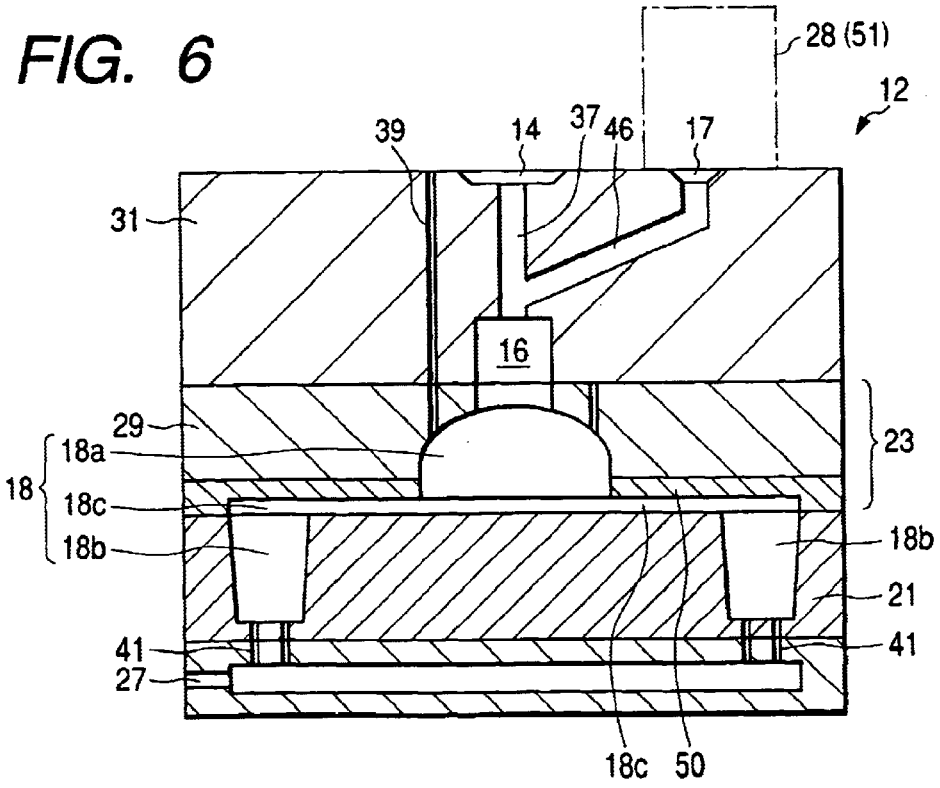
FIG. 6 is a cross-sectional view of a fourth embodiment of a molding die according to the invention.

Further, as shown in FIG. 6, the narrow portions 18*c* may be arranged in a heat insulating plate 50 comprising a material having a higher heat insulating property than metal, such as ceramic or the like. The narrow portions 18*c* arranged in the heat insulating plate 50 can improve the heat insulating property without applying the heat insulating coating agent on the surface of the inner wall thereof compared with the cavity 18 arranged in the lower and upper dies 21 and 23.

In a manner as described above, it is possible to allow the transferring property (flatness) of a surface texture relative to the surface of the inner wall of each of the narrow portions 18*c* to be favorable by not applying the heat insulating coating agent on the surface of the inner wall of each of the narrow portions 18*c*.

However, in the molding die 12 shown in FIG. 6, though the heat insulating coating agent is applied on the surface of the inner wall of the feeder head portion 16, since a part of the molten metal which is filled and solidified in the feeder head portion 16 is to be cut off from the product, it is not necessary to consider the transferring property with reference to the part.

Further, the furnace 28 shown in FIG. 1, as shown in FIG. 6, may be arranged right above the metallic gas-introducing port 17 of the molding die 12 or a reaction tank 51 in which a magnesium gas as a metallic gas which has been gasified in the furnace 28 and a nitrogen gas as a reactive gas which reacts with the metallic gas are reacted with each other to generate the reducing compound, that is, the magnesium-nitrogen compound ($Mg_3N_2$) may be arranged right above the metallic gas-introducing port 17 of the molding die 12.

In the cavity 18 of the molding die 12 shown in FIGS. 1 to 2B and 4 to 6, the first cavity portion 18*a* which is arranged nearest to the feeder head portion 16 and the second cavity portion 18*b* as a terminal portion of the cavity 18 are connected with each other by the narrow portion 18*c* which has been formed narrower than the cavity portions 18*a* and 18*b*.

Figure 7:
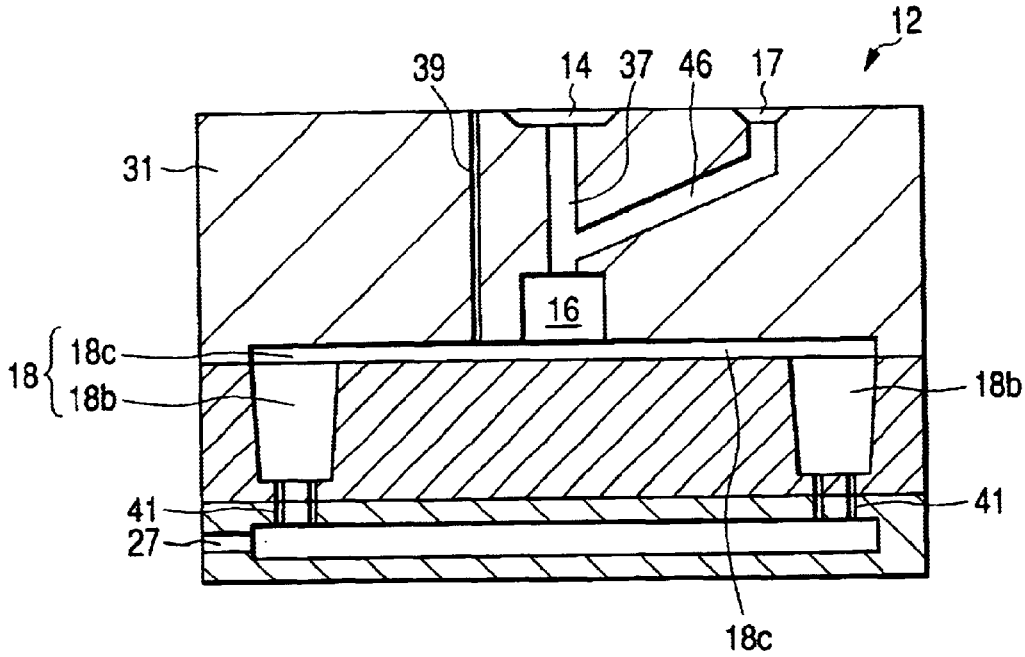
FIG. 7 is a cross-sectional view of a fifth embodiment of a molding die according to the invention.
Figure 8:
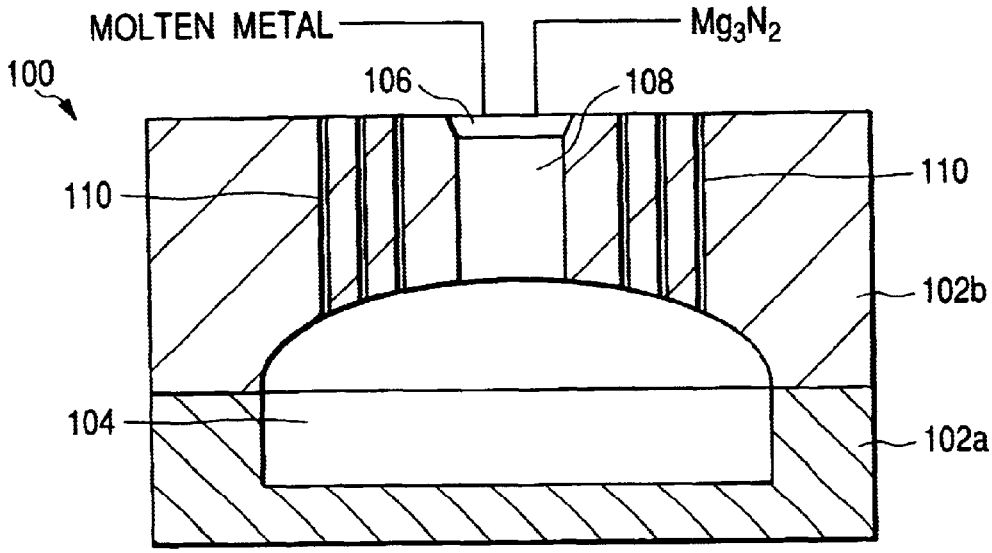
FIG. 8 is a view explaining an aluminum casting method previously proposed by two of the present inventors.

Contrary to such molding die 12 as described above, as shown in FIG. 7, the molding die 12 in which the feeder head portion 16 and the cavity portions 18*b* which are terminal portions are connected with each other by narrow portions 18*c* arranged nearest to the feeder head portion 16 can favorably be adopted. In the molding die 12 shown in FIG. 7, since the heat insulating coating agent is adapted on the surface of the inner wall of each of the feeder head portion 16 and the narrow portions 18*c*, the difference of the heat insulation temperature thereon from that on a plurality of cavity portions 18*b* can easily be provided.

Further, in the molding die 12 shown in FIGS. 1 to 2B and 4 to 6, though the feeder head portion 16 is arranged in a halfway of the molten metal passage 37, the feeder head portion 16 may separately be arranged apart from the molten metal passage 37.

Heretofore, the casting method which uses the molten metal of aluminum or the alloy thereof as molten metal has been described, but the present invention is not limited thereto and can also be applied to a molding method which uses the molten metal of any other metal such as magnesium, iron or the like or an alloy thereof.

According to the present invention, even when casting is performed by using a molding die in which a number of a feeder head portion to be formed between a sprue and a cavity having a complicated shape is allowed to be as small as possible, shrinkage hole or the like which is caused by shrinkage with solidification of the molten metal filled in the cavity can be prevented. For this reason, a cast product having a complicated shape in which a number of shrinkage holes and the like is as small as possible can be cast while attempting energy saving.

What is claimed is:

1. A gravity die casting method for casting a cast product having a desired shape, comprising the steps of:

using a molding die having a cavity, a sprue from which a molten metal is poured and a feeder head portion arranged between the sprue and the cavity for casting a cast product, the molding die being formed from a material having a higher heat insulating property than a material forming the cavity such that the molding die being formed has a difference of heat insulation between the feeder head portion and the cavity such that the molten metal filled in the cavity and the feeder head portion is sequentially solidified in a direction of from a terminal portion of the cavity to the feeder head portion;

pouring the molten metal into the cavity of the molding die;

reducing an oxide film formed on a surface of the molten metal by allowing the molten metal and a reducing compound to be contacted with each other in the cavity of the molding die;

setting a cooling rate of the molten metal filled in an uncoated area of the cavity at about 500° C./min. or more and a cooling rate of the molten metal poured into the feeder head portion at about 500° C./min. or less; and solidifying the molten metal filled in the cavity, whereby at least a part of the molten metal filled in the feeder head portion is replenished in the cavity, when a void is formed by shrinkage at the time of the solidifying step.

2. The casting method as set forth in claim 1, wherein the cavity of the molding die comprises a narrow portion arranged halfway between a feeder head portion side inlet thereof which is connected with the feeder head portion and the terminal portion thereof and having a smaller cross-sectional area than the terminal portion;

wherein the feeder head portion and the narrow portion are formed such as to have a higher heat insulating property than the terminal portion.

3. The casting method as set forth in claim 2, wherein a part of the molding die defining the feeder head portion is formed by a material that has a higher heat insulating property than a material defining the terminal portion of the cavity.

4. The casting method as set forth in claim 2, wherein a part of the molding die defining the narrow portion of the cavity is formed by a material that has a higher heat insulating property than a material defining the terminal portion of the cavity.

5. The casting method as set forth in claim 2, further comprising the step of:

performing a heat insulating treatment on an inner wall surface of at least one of the feeder head portion and the narrow portion of the cavity by applying a heat insulating coating agent thereto, the heat insulating coating agent being non-reactive to a reducing compound which contacts the molten metal, wherein an inner wall surface of the terminal portion of the cavity is free from the heat insulating treatment.

6. The molding method as set forth in claim 1, wherein a part of the molding die defining the feeder head portion is constructed such as to be detachable from a cavity portion of the molding die.

7. The casting method as set forth in claim 1, wherein a part of the molding die defining the feeder head portion forms a molten metal-introducing passage that introduces the molten metal into the feeder head portion, and an introducing passage that introduces raw materials of the reducing compound into the cavity such that the reducing compound is generated in the cavity.

8. The casting method as set forth in claim 1, wherein molten metal of aluminum or an alloy thereof is used as the molten metal, and wherein a magnesium-nitrogen compound which is obtained by allowing a magnesium gas and a nitrogen gas as raw materials to be reacted with each other is used as the reducing compound.

9. The casting method as set forth in claim 1, wherein in the solidifying step, a difference of a cooling rate between the molten metal filled in the feeder head portion and the molten metal filled in the terminal portion of the cavity is set to be 200° C./min or more.

10. The casting method as set forth in claim 1, further comprising providing a non-oxide insulating coating on a narrow portion of the cavity arranged between the feeder head portion and the terminal portion of the cavity, wherein the feeder head portion and the narrow portion has a difference of heat insulation than the terminal portion of the cavity such that the molten metal filled in the terminal portion of the cavity and the feeder head portion is sequentially solidified in a direction of from the terminal portion of the cavity to the feeder head portion.

11. The casting method as set forth in claim 10, wherein the non-oxide insulating coating is a ceramic compounded graphite.

12. The casting method as set forth in claim 1, further comprising providing a narrow portion of the cavity arranged between the feeder head portion and the terminal portion of the cavity such that the narrow portion is formed of the material having a higher heat insulating property than the material forming the terminal portion of the cavity.

13. The casting method as set forth in claim 1, wherein the reducing compound is magnesium nitrogen.

14. The casting method as set forth in claim 1, further comprising preventing a blocking by the reducing compound by arranging a molten metal-introducing passage that introduces the molten metal into the feeder head portion and an introducing passage that introduces a raw material of the reducing compound into the cavity such that the reducing compound is generated in the cavity in a part of the molding die in which the feeder head portion is arranged.

15. The casting method as set forth in claim 1, wherein the cavity includes a first cavity portion having a higher capacity than a second cavity portion and a narrow cavity portion having less capacity than the first and second cavity portion such the, the order of solidification of filled molten metal can be adjusted by adjusting a heat insulating treatment on a surface of an inner wall of the narrow cavity portion such that solidification occurs from the second cavity portion to the narrow portion to the first cavity portion to the feeder head portion.

16. The casting method as set forth in claim 15, wherein the cooling rate of the molten metal filled in the cavity at about 500° C./min. or more fully secures the difference of solidification time of the molten metal between the molten metal filled in the feeder head portion and the molten metal filled in first and second cavity portions of the cavity.

17. The casting method as set forth in claim 16, further comprising setting the cooling rate of the molten metal filled in the uncoated portion of the cavity at 700° C./min or more.

18. The casting method as set forth in claim 15, further comprising setting a cooling rate of the molten metal poured into the feeder head portion at less than 500° C./min in order to fully secure the difference of solidification time of the molten metal between the molten metal filled in the feeder head portion and the molten metal filled in the first and second cavity portions.

19. The casting method as act forth in claim 18, further comprising setting a cooling rate of the molten metal poured into the feeder head portion at less than 300° C./min.

20. The casting method as set forth in claim 1, wherein the narrow portion and the feed head portion have an insulating coating.

21. The casting method as set forth in claim 1, wherein the cooling rate of the molten metal poured into the feeder head portion at about 300° C./min.

22. The casting method as set forth in claim 1, wherein the cooling rates provide a difference in solidification time between the feeder head portion and the uncoated area of the cavity.

23. A gravity die casting method for casting a cast product having a desired shape, comprising the steps of:

using a molding die having a cavity, a sprue from which a molten metal is poured and a feeder head portion arranged between the sprue and the cavity for casting a cast product, the cavity having a first portion, a second portion and an intermediate narrow portion disposed between the first portion and the second portion, the feeder head portion and the narrow portion being formed from a same material having a higher heat insulating property than a material forming the first portion and the second portion of the cavity such that the feeder head portion and narrow portion has a difference of heat insulation provided than the first and second portion of the cavity such that the molten metal filled in the cavity and the feeder head portion is sequentially solidified in a direction of from a terminal portion of the cavity to the feeder head portion;

pouring the molten metal into the cavity of the molding die;

reducing an oxide film formed on a surface of the molten metal by allowing the molten metal and a reducing compound to be contacted with each other in the cavity of the molding die;

setting a cooling rate of the molten metal filled in an uncoated area of the cavity at about 500° C./min. or more and a cooling rate of the molten metal poured into the feeder head portion at about 500° C./min. or less; and solidifying the molten metal filled in the cavity, whereby at least a part of the molten metal filled in the feeder head portion is replenished in the cavity, when a void is formed by shrinkage at the time of the solidifying step.

24. A gravity die casting method for casting a cast product having a desired shape, comprising the steps of:

using a molding die having a cavity, a sprue from which a molten metal is poured and a feeder head portion arranged between the sprue and the cavity for casting a cast product, the cavity having a first portion, a second portion and an intermediate narrow portion disposed between the first portion and the second portion, the feeder head portion being formed from a material having a higher heat insulating property than a material forming the first portion and the second portion of the cavity and the narrow portion being coated with a non-oxide insulating coating having a higher heat insulating property than the material forming the first portion and the second portion of the cavity such that the feeder head portion and narrow portion has a difference of heat insulation than the first and second portion of the cavity such that the molten metal filled in the cavity and the feeder head portion is sequentially solidified in a direction of from a terminal portion of the cavity to the feeder head portion;

pouring the molten metal into the cavity of the molding die;

reducing an oxide film formed on a surface of the molten metal by allowing the molten metal and a reducing compound to be contacted with each other in the cavity of the molding die;

setting a cooling rate of the molten metal filled in an uncoated area of the cavity at about 500° C./min. or more and a cooling rate of the molten metal poured into the feeder head portion at about 500° C./min. or less; and solidifying the molten metal filled in the cavity, whereby at least a part of the molten metal filled in the feeder head portion is replenished in the cavity, when a void is formed by shrinkage at the time of the solidifying step.

25. A casting method for casting a cast product having a desired shape, comprising the steps of:

using a molding die having a cavity, a sprue from which a molten metal is poured and a feeder head portion arranged between the sprue and the cavity for casting a cast product, the feeder head portion being formed from a material having a higher heat insulating property than a material forming portions of the cavity such that the molding die being formed has a difference of heat insulation between the feeder head portion and the portions of the cavity such that the molten metal filled in the cavity and the feeder head portion is sequentially solidified in a direction of from a terminal portion of the cavity to the feeder head portion;

pouring the molten metal into the cavity of the molding die;

reducing an oxide film formed on a surface of the molten metal by providing a carrier gas into a receptacle which holds a reducing compound to transfer the reducing compound from the receptacle to the cavity, the carrier gas does not react with the reducing compound during the transfer to the cavity;

allowing the molten metal and the reducing compound to be contacted with each other in the cavity of the molding die; and solidifying the molten metal filled in the cavity, whereby at least a part of the molten metal filled in the feeder head portion is replenished in the cavity, when a void is formed by shrinkage at the time of the solidifying step.

* * * * *